US007076933B2

(12) United States Patent
Backus

(10) Patent No.: US 7,076,933 B2
(45) Date of Patent: Jul. 18, 2006

(54) METHOD FOR PACKING PRODUCTS PRONE TO DECAY

(75) Inventor: Stephanus Michael Marie Backus, Venlo (NL)

(73) Assignee: Perfo Tec B.V. (NL)

( * ) Notice: Subject to any disclaimer, the term of this patent is extended or adjusted under 35 U.S.C. 154(b) by 0 days.

(21) Appl. No.: 10/343,722

(22) PCT Filed: Aug. 2, 2001

(86) PCT No.: PCT/EP01/08944

§ 371 (c)(1),
(2), (4) Date: May 23, 2003

(87) PCT Pub. No.: WO02/12068

PCT Pub. Date: Feb. 14, 2002

(65) Prior Publication Data

US 2003/0172627 A1 Sep. 18, 2003

(51) Int. Cl.
*B65B 1/30* (2006.01)

(52) U.S. Cl. ..... 53/493; 53/55; 53/203; 53/452; 53/52

(58) Field of Classification Search ..... 53/452, 53/52, 55, 493, 51, 485, 477, 478, 467, 509, 53/203; 493/8
See application file for complete search history.

(56) References Cited

U.S. PATENT DOCUMENTS

| | | | | |
|---|---|---|---|---|
| 4,924,657 | A * | 5/1990 | Berti et al. | 53/450 |
| 5,208,762 | A * | 5/1993 | Charhut et al. | 700/216 |
| 5,351,464 | A * | 10/1994 | Francioni | 53/450 |
| 5,492,705 | A * | 2/1996 | Porchia et al. | 426/106 |
| 5,704,190 | A * | 1/1998 | Kaneko et al. | 53/51 |
| 5,936,863 | A * | 8/1999 | Kostelnik et al. | 700/171 |
| 6,148,587 | A * | 11/2000 | McDonald et al. | 53/255 |
| 6,221,411 | B1 * | 4/2001 | Sanfilippo et al. | 426/129 |
| 6,346,680 | B1 * | 2/2002 | Takahashi et al. | 177/1 |
| 6,427,420 | B1 * | 8/2002 | Olivieri et al. | 53/412 |
| 6,473,718 | B1 * | 10/2002 | Bierschenk et al. | 702/155 |
| 6,511,688 | B1 * | 1/2003 | Edwards et al. | 426/130 |
| 6,615,104 | B1 * | 9/2003 | England et al. | 700/213 |

* cited by examiner

*Primary Examiner*—John Sipos
*Assistant Examiner*—Christopher Harmon
(74) *Attorney, Agent, or Firm*—Gary M. Hartman; Domencia N. S. Hartman; Hartman & Hartman

(57) ABSTRACT

A method and apparatus for packaging food products in a synthetic foil. The method generally comprising transporting the synthetic foil through a punching device in which perforations are made in the synthetic foil with high energy beams to yield a perforated foil. The perforations are made in the synthetic foil to achieve a perforation surface per surface unit of the synthetic foil set according to the food product to be packaged, and the perforation surface per surface unit of the synthetic foil is achieved by controlling at least one of the number and intensity of the high energy beams projected onto the synthetic foil. The perforated foil are then formed into packages, filled with the food product, and closed to enclose the food product.

20 Claims, 1 Drawing Sheet

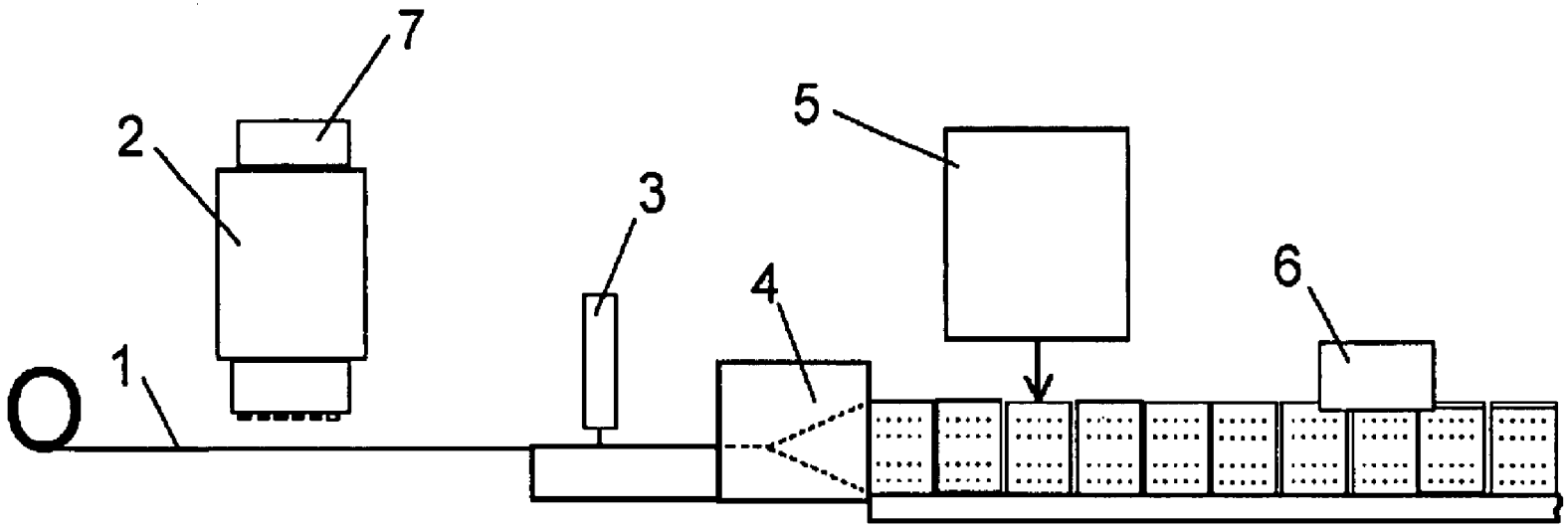
7
2
3
1
5
4
6

METHOD FOR PACKING PRODUCTS PRONE TO DECAY

BACKGROUND OF THE INVENTION

Field of the Invention

The invention relates to a method for packaging products prone to decay, such as food products, more particularly vegetables and/or fruit in a synthetic foil, wherein the synthetic foil is transported through a punching device in which the perforations are made n the synthetic foil, the perforated foil is formed into packages having the desired dimensions and these packages are filled with the products and closed, the perforation surface per surface unit synthetic foil being determined depending upon the product to be packaged and the perforations being obtained by means of high energy beams.

Packaging vegetables and/or fruit in packages, more particularly bags made of synthetic foil, whereby the synthetic foil is provided with perforations, is known from WO-A-93.22207 and DE-A-1952341.

This way, it is aimed at allowing the package to "breathe," improving thereby shelf kfe for the product. This patent application describes more in detail that the perforation size, i.e. the size of each perforation combined with the perforation number should be determined depending upon the nature of the product to be packaged.

Consequently, this leads to the problem that another type of package should be used for each type of product, which involves in practice that a large number of different types of packages such as bags should be available in stock. On the other hand, as the package is made in situ from perforated foil, a large number of different foils should be available in stock, each time for the pertaining products.

The invention aims at offering a method for packaging food products being prone to decay so as to alleviate this problem.

BRIEF SUMMARY OF THE INVENTION

The aim is reached according to the invention by means of a method for packaging products prone to decay, such as food products, more particularly vegetables and/or fruit in a synthetic foil, wherein the synthetic foil is transported through a punching device in which the perforations are made in the synthetic foil, the perforated foil is formed into packages having the desired dimensions and these packages are filled with the products and closed, the perforation surface per surface unit synthetic foil being determined depending upon the product to be packaged and the perforations being obtained by means of high energy beams, characterized in that the perforation surface per surface unit of synthetic foil is set by controlling the number of emerging high energy emitters and/or the beam intensity.

With this method, It can be achieved that only a limited number of synthetic foils should be available in stock, since the perforations are only punched at the start of the packaging process. The synthetic foil types that should be available in stock are thereby reduced to the types of various thickness, colour and/or other quality requirements, but depend upon the desired perforation, that can again be punched each time.

The invention also relates to a device for applying the above-mentioned method, said device being characterized by a combination of a feeding device for feeding a synthetic foil, a device for perforating the synthetic foil, a device for forming a package from the perforated synthetic foil, a device for filling the formed package with products, and a device for sealing the filled package, said device being characterized in that the various devices are combined into an integrated device.

Preferably, the device is provided with regulation elements by means of which the perforation surface per surface unit is controlled.

BRIEF DESCRIPTION OF THE DRAWINGS

Other features and advantages of the invention will become evident from the following description referring to the accompanying drawings, wherein the various method steps are illustrated.

DETAILED DESCRIPTION OF THE INVENTION

In the FIGURE, the annotation 1 schematically illustrates a synthetic foil from stock. This stock may consist in a synthetic foil roll which is unrolled and is conveyed as a continuous strip towards a perforation device 2. It is also possible to start from a stock 1 consisting in separate sheets of synthetic foil, which are conveyed one by one towards the perforation device 2.

In the perforation device 2, the continuous synthetic foil strips or separate sheets of synthetic foil are supplied with perforations. Punching can be done different ways, for example, with fines needles and similar means, but preferably use is made of laser beam perforations. In that aspect, a row of high energy emitters such as laser beam generators can be mounted in device 2, which can extend over the whole width of the supplied synthetic strip or synthetic sheet or over a part of the width. Preferably, the row of laser beam generators extends over a small section, seen in the width, since it is in general sufficient when only part of the package is perforated. Thereby, the numbers of laser beam generators can be kept limited. Perforations can be punched in the synthetic foils through an intermittent activation of the laser beam generators and the appropriate control of the laser beam intensity.

Thereby, it is possible to control the perforation number per surface unit, either by activating or not all the laser beam generators, or by setting the frequency at which the laser beam generators are activated or both. Moreover, the size of each individual perforation can be controlled by controlling the intensity for the laser beam generators. This way, the perforation surface (that is the total surface of the perforations) can be set by surface unit.

As disclosed in WO-A-9322207, it is important to set the perforation surface for each product type, in order to reach an optimum effect. By means of the punching device 2 in cooperation with an appropriate controller 7, the total perforation surface per surface unit can easily be set, via an electronic way, according to the product that is to be packaged, in order to obtain an optimum shelf life of the product to be packaged.

Determining the perforation surface can be done based on calculations, but this is preferably determined based on experimental results.

After the synthetic foil is thus provided with perforations, it is further conveyed in an operation step towards a device 4 for forming bags. In the case of a continuous strip, the synthetic foil first passes through a device 3 in which the strip is cut into separate sheets with the desired sizes. In the case of sheets, this device 3 can be omitted.

After these bags have been formed, they are conveyed further towards a filling machine 5, where the shaped bags are filled with a measured quantity of food products, which are also supplied to the filling machine 5.

Further, these filled bags 5 are finally conveyed towards a closing machine 6, where the bags are closed in an appropriate way, for example, by means of a heat sealing equipment.

In another embodiment of the invention, the packages are formed by double folding part of the synthetic foil, viewed in the moving direction, and by closing the thus formed edge for example through an heat sealing process. Consecutively or approximately simultaneously with the longitudinal edge being formed, a transversal edge is formed, which is designed as the packaging bottom. Under this form, the thus formed bag is filled with products. Subsequently, a new transversal edge follows, by which the formed and filled package is closed and isolated from the synthetic foil. Preferably in the course of the packaging closure, the bottom edge of the following package is simultaneously formed.

It is obvious that the invention is not limited to the described and illustrated embodiment, but numerous modifications can be made within the scope of the claims. For example, it is more particularly possible to first form the packing after the food products have been placed on a synthetic foil sheet, which actually implies an inversion of steps 4 and 5.

The invention claimed is:

1. A method for continuously forming separate perforated packages and packaging different types of food products therein, the method comprising the steps of:

identifying a type of a food product to be packaged with the separate perforated packages;

transporting a synthetic foil through a punching device in which perforations are made in the synthetic foil to yield a perforated foil;

controlling the punching device according to electronic settings to form the perforations in the perforated foil to achieve a perforation surface per surface unit of the synthetic foil according to the type of the food product identified as to be packaged so as to optimize the shelf life of the food product when packaged within the separate perforated packapes, the perforation surface per surface unit of the synthetic foil being achieved by controlling at least the number of the perforations formed in the synthetic foil; and then conveying the perforated foil to means that form and fill the perforated foil to yield the separate perforated packages in each of which the food product is enclosed and a plurality of the perforations are present to allow each of the separate perforated packages to breathe while filled with the food product.

2. The method according to claim 1, wherein the separate perforated packages are formed before being filled with the food product.

3. An apparatus for performing the method according to claim 1, wherein the apparatus comprises:

the punching device having means for making the perforations;

means for transporting the synthetic foil through the punching device;

means for forming the perforated foil into the separate perforated packages;

means for filling the perforated foil with the food product;

means for closing the separate perforated packages after being filled with the food product; and means for associating the perforation surface per surface unit of the synthetic foil with the type of the food product;

wherein the punching device, the transporting means, the forming means, the filling means, the closing means and the associating means are combined as an integrated assembly within which the separate perforated packages are continuously formed and the food products are continuously packaged.

4. The apparatus according to claim 3, wherein the means for making the perforations comprises means for generating high energy beams, and the generating means is controlled by the associating means.

5. The method according to claim 1, further comprising the step of varying the perforation surface per surface unit of the synthetic foil by controlling the number of the perforations formed in the synthetic foil.

6. The method according to claim 1, wherein the perforation surface per surface unit of the synthetic foil is further achieved by also controlling the size of the perforations formed in the synthetic foil.

7. The method according to claim 1, wherein the types of food products are chosen from the group consisting of fruits and vegetables.

8. The method according to claim 1, wherein the synthetic foil is in the form of separate sheets when transported to the punching device.

9. The method according to claim , wherein the synthetic foil is in the form of continuous strip when transported to the punching device, and forming the perforated foil to yield the separate perforated packages comprises cutting the continuous strip into separate sheets.

10. The method according to claim 9, wherein forming the perforated foil to yield the separate perforated packages comprises double folding the continuous strip to form a longitudinal edge and then sealing the longitudinal edge.

11. A method for continuously forming separate perforated packages and continuously packaging food products therein, the method comprising the steps of:

identifying a type of a food product to be packaged with the separate perforated packages;

transporting separate sheets of a synthetic foil through a punching device in which perforations are made in the separate sheets with high energy beams to yield separate perforated sheets;

controlling the punching device according to electronic settings to form the perforations in the separate sheets of the synthetic foil to achieve a perforation surface per surface unit of each separate sheet according to the type of the food product identified as to be packaged therein so as to optimize the shelf life of the food product when packaged within the separate perforated packages, the perforation surface per surface unit of each separate sheet being achieved by controlling at least the number of the perforations formed in the separate sheet with the high energy beams;

conveying and then forming the separate perforated sheets into the separate perforated packages;

conveying and then filling each of the separate perforated packages with the food product; and conveying and then closing the separate perforated packages to enclose the food product, a plurality of the perforations being present in each of the separate perforated packages to allow each of the separate perforated packages to breathe immediately following closing of the separate perforated packages and while filled with the food product.

12. An apparatus for performing the method according to claim 11, wherein the apparatus comprises:

the punching device having means for generating the high energy beams;

means for transporting the separate sheets of the synthetic foil through the punching device;

means for forming the separate perforated sheets into the separate perforated packages;

means for filling the separate perforated packages with the food product;

means for closing the separate perforated packages after being filled with the food product; and means for associating the perforation surface per surface unit of the separate sheets with the type of the food product;

wherein the punching device, the transporting means, the forming means, the filling means, the closing means, and the associating means are combined as an integrated assembly within which the separate perforated packages are continuously formed and the food products are continuously packaged.

13. The method according to claim 11, further comprising the step of varying the perforation surface per surface unit of the separate sheets by controlling the number of the perforations formed in the separate sheets.

14. The method according to claim 11, wherein the perforation surface per surface unit of each separate sheet is further achieved by also controlling the size of the perforations formed in each separate sheet by controlling the intensity of the high energy beams projected onto each separate sheet.

15. The method according to claim 11, wherein the types of food products are chosen from the group consisting of fruits and vegetables.

16. A method for continuously forming separate perforated packages and continuously packaging food products therein, the method comprising the steps of:

identifying a type of a food product to be packaged with the separate perforated packages;

transporting a continuous strip of a synthetic foil through a punching device in which perforations are made in the synthetic foil with high energy beams to yield a continuous strip of a perforated foil;

controlling the punching device according to electronic settings to form the perforations in the synthetic foil to achieve a perforation surface per surface unit of the synthetic foil according to the type of the food product identified as to be packaged therein so as to optimize the shelf life of the food product when packaged within the separate perforated packages, the perforation surface per surface unit of the synthetic foil being achieved by controlling at least the number of the perforations formed in the synthetic foil with the high energy beams;

conveying and then cutting the continuous strip of the perforated foil into separate perforated sheets, each separate perforated sheet having a size according to the type and quantity of the food product to be packaged therein;

conveying and then forming the separate perforated sheets into the separate perforated packages;

conveying and then filling each of the separate perforated packages with the food product; and conveying and then closing the separate perforated packages to enclose the food product, a plurality of the perforations being present in each of the separate perforated packages to allow each of the separate perforated packages to breathe immediately following closing of the separate perforated packages and while filled with the food product.

17. An apparatus for performing the method according to claim 16, wherein the apparatus comprises:

the punching device having means for generating the high energy beams;

means for transporting the continuous strip of the synthetic foil through the punching device;

means for forming the separate perforated sheets into the separate perforated packages;

means for filling the separate perforated packages with the food product;

means for closing the separate perforated packages after being filled with the food product; and means for associating the perforation surface per surface unit of the synthetic foil with the type of the food product;

wherein the punching device, the transporting means, the forming means, the filling means, the closing means, and the associating means are combined as an integrated assembly within which the separate perforated packages are continuously formed and the food products are continuously packaged.

18. The method according to claim 16, further comprising the step of varying the perforation surface per surface unit of the synthetic foil by controlling the number of the perforations formed in the synthetic foil.

19. The method according to claim 16, wherein the perforation surface per surface unit of the synthetic foil is further achieved by also controlling the size of the perforations formed in the synthetic foil by controlling the intensity of the high energy beams projected onto the synthetic foil.

20. The method according to claim 16, wherein the types of food products are chosen from the group consisting of fruits and vegetables.

* * * * *